US010109950B1

(12) United States Patent
Campbell et al.

(10) Patent No.: US 10,109,950 B1
(45) Date of Patent: Oct. 23, 2018

(54) HIGH VIBRATION CONNECTOR WITH A CONNECTOR-POSITION-ASSURANCE DEVICE

(71) Applicant: Delphi Technologies, Inc., Troy, MI (US)

(72) Inventors: Jeffrey Scott Campbell, West Bloomfield, MI (US); Rangarajan Sundarakrishnamachari, Chennai (IN); Rathnakumar Ramaswamy, Chennai (IN)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/703,252

(22) Filed: Sep. 13, 2017

(51) Int. Cl.
*H01R 13/627* (2006.01)
*H01R 13/11* (2006.01)
*H01R 13/639* (2006.01)
*H01R 13/05* (2006.01)

(52) U.S. Cl.
CPC ..... *H01R 13/6278* (2013.01); *H01R 13/05* (2013.01); *H01R 13/11* (2013.01); *H01R 13/6272* (2013.01); *H01R 13/639* (2013.01)

(58) Field of Classification Search
CPC .... H01R 13/6278; H01R 13/05; H01R 13/11; H01R 13/6272; H01R 13/639; H01R 13/6271; H01R 13/6275; H01R 13/4362
USPC ..... 439/352, 357, 382, 752
See application file for complete search history.

(56) References Cited

U.S. PATENT DOCUMENTS 4,746,306 A * 5/1988 Yurtin ..... H01R 13/641 439/352
5,236,373 A * 8/1993 Kennedy ..... H01R 13/639 439/347
5,370,550 A * 12/1994 Alwine ..... H01R 13/6272 439/352
5,947,763 A * 9/1999 Alaksin ..... H01R 13/4368 439/352
6,024,595 A * 2/2000 Saba ..... H01R 13/6272 439/352
6,514,098 B2 * 2/2003 Marpoe, Jr. ..... H01R 13/64 439/352
7,326,074 B1 * 2/2008 Lim ..... H01R 13/629 439/352
7,544,081 B2 * 6/2009 Lim ..... H01R 13/4361 439/352
8,137,142 B1 * 3/2012 Dawson ..... H01R 13/639 439/676

(Continued)

*Primary Examiner* — Hae Moon Hyeon
(74) *Attorney, Agent, or Firm* — Robert J. Myers

(57) ABSTRACT

A connector includes a first-housing and a second-housing. The first-housing includes a connector-lock. The second-housing is configured to receive the first-housing and includes a connector-latch configured to removably retain the connector-lock when the first-housing is mated with the second-housing. The second-housing includes a connector-position-assurance (CPA)-device slidably mounted to the second-housing and movable from a disengaged-position to an engaged-position. The CPA-device applies a retention-force to the connector-latch. The retention-force deflects the connector-latch thereby applying the retention-force to the first-housing when the first-housing is mated with the second-housing and the CPA-device is in the engaged-position.

10 Claims, 5 Drawing Sheets

(56) References Cited

U.S. PATENT DOCUMENTS

| | | | | |
|---|---|---|---|---|
| 8,678,846 | B2 * | 3/2014 | Hitchcock ..... | H01R 13/6272 439/352 |
| 8,989,944 | B1 | 3/2015 | Agarwal et al. | |
| 2006/0293856 | A1 | 12/2006 | Foessel et al. | |
| 2014/0350838 | A1 | 11/2014 | Hayashi | |
| 2015/0336575 | A1 | 11/2015 | Zeng | |
| 2016/0042645 | A1 | 2/2016 | Harada et al. | |

* cited by examiner

HIGH VIBRATION CONNECTOR WITH A CONNECTOR-POSITION-ASSURANCE DEVICE

TECHNICAL FIELD OF INVENTION

This disclosure generally relates to a connector, and more particularly relates to a connector that withstands a high vibrational environment.

BACKGROUND OF INVENTION

It is known for connectors, especially electrical connectors, to fail from high vibration due to excessive relative movement between the components of the connectors. Connectors located on an internal combustion engine are particularly susceptible to increased failure rates due to vibration profiles exerted on the connectors by the engine coupled with the high temperature environment characteristic of operation on the engine. Typical high vibration connector systems employ high contact force electrical terminals with non-standard housings that are higher in cost and require increased insertion forces to mate the connectors compared to standard automotive connector systems.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY OF THE INVENTION

As described herein, the problem of relative movement between components of a connector due to high vibrations is solved by reducing a spacing between those components without increasing an insertion-force required to assemble and mate the components.

In accordance with one embodiment, a connector is provided. The connector includes a first-housing and a second-housing. The first-housing includes a connector-lock. The second-housing is configured to receive the first-housing and includes a connector-latch configured to removably retain the connector-lock when the first-housing is mated with the second-housing. The second-housing includes a connector-position-assurance (CPA)-device slideably mounted to the second-housing and movable from a disengaged-position to an engaged-position. The CPA-device applies a retention-force to the connector-latch. The retention-force deflects the connector-latch thereby applying the retention-force to the first-housing when the first-housing is mated with the second-housing and the CPA-device is in the engaged-position.

The connector may have a clearance between the connector-latch and the first-housing that is less than 0.1 millimeters, and the retention-force may be at least 1 Newton. The CPA-device may include a snap feature configured to provide a vibratory-feedback to an assembler indicative of a properly positioned CPA-device when the CPA-device is moved to the engaged-position. The CPA-device is moveable in a direction generally perpendicular to an insertion direction of the first-housing into the second-housing.

The first-housing includes a plurality of electrical-terminals and the second-housing includes a plurality of corresponding electrical-terminals configured to mate with the plurality of electrical-terminals of the first-housing. The first-housing defines a plurality of slots that define apertures, wherein a portion of the plurality of electrical-terminals are disposed within the apertures. The connector further includes a terminal-lock that includes a plurality of ribs configured to slideably engage the plurality of slots. A clearance between the plurality of ribs and the plurality of electrical-terminals is less than 0.1 millimeters. The plurality of ribs contact the plurality of electrical-terminals through the apertures, thereby applying a compressive-force to the plurality of electrical-terminals. The compressive-force is at least 1 Newton.

The second-housing defines a second plurality of slots that define second-apertures, wherein a portion of the plurality of corresponding electrical-terminals are disposed within the second-apertures. The connector further includes a second terminal-lock that includes a second plurality of ribs configured to slideably engage the second plurality of slots. The clearance between the second plurality of ribs and the plurality of corresponding electrical-terminals is less than 0.1 millimeters. The second plurality of ribs contact the plurality of corresponding electrical-terminals through the second-apertures, thereby applying a compressive-force to the plurality of corresponding electrical-terminals. The compressive-force is at least 1 Newton.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
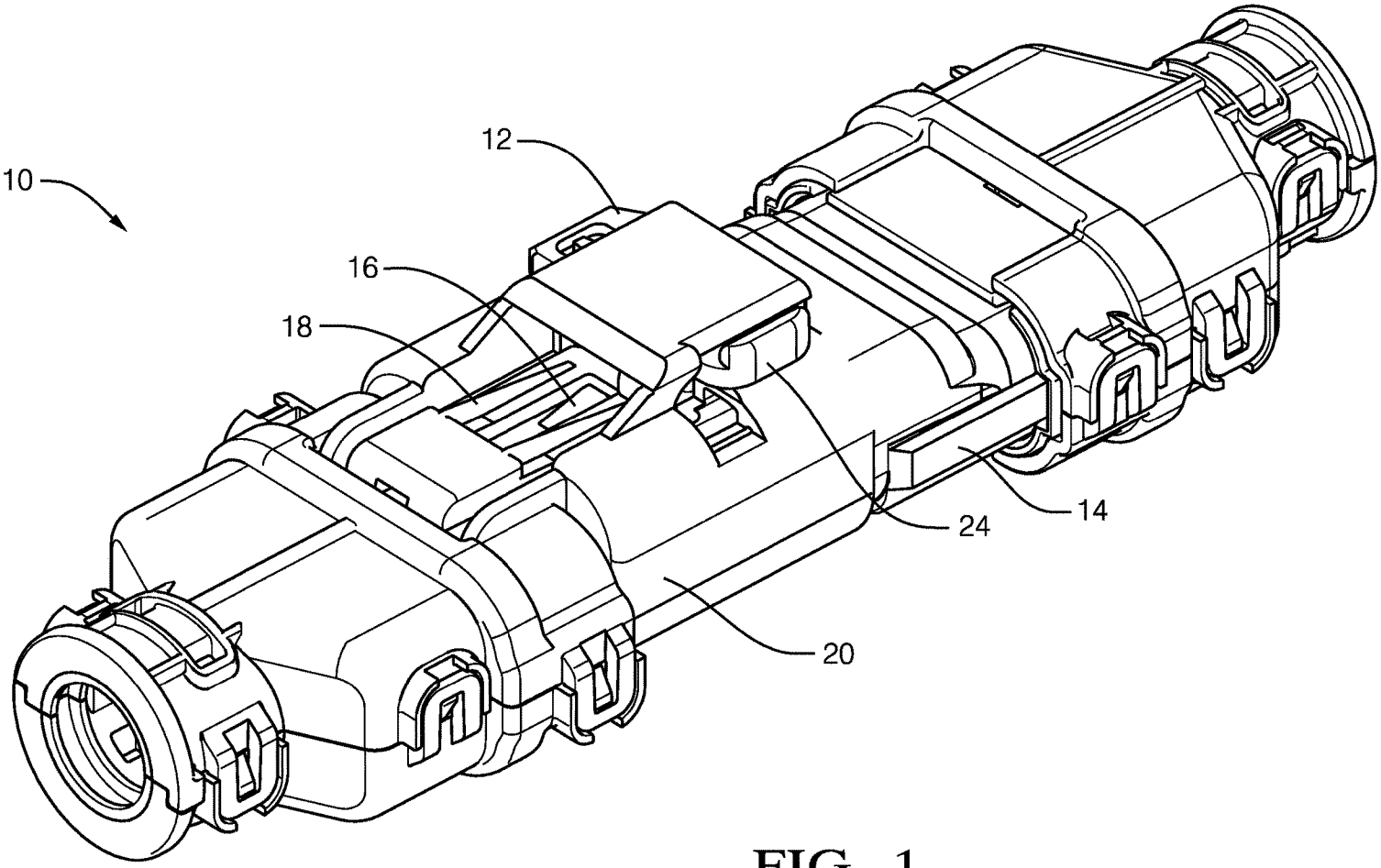
FIG. 1 is a perspective view of an illustration of a connector in accordance with one embodiment.

FIG. 1 illustrates a non-limiting example of a connector 10 with a connector-position-assurance (CPA)-device 12. The connector 10 may be attached to a wire-bundle (not shown) connected to a wire-harness or other electrical-components (not shown).

The connector 10 includes a first-housing 14 that includes a connector-lock 16. The connector-lock 16 is configured engage a connector-latch 18 on a second-housing 20, as will be described in more detail below. The first-housing 14 may include wire seals and strain relief features for the wires (not shown).

The connector 10 also includes the second-housing 20 configured to receive the first-housing 14. The second-housing 20 may also include wire seals and strain relief features for the wires (not shown). The second-housing 20 also includes the connector-latch 18 configured to removably retain the connector-lock 16 when the first-housing 14 is mated with the second-housing 20. The second-housing 20 also includes the CPA-device 12 slideably mounted to the second-housing 20 and movable from a disengaged-position 22 to an engaged-position 24 (see FIGS. 2A-2B).

Figure 2A:
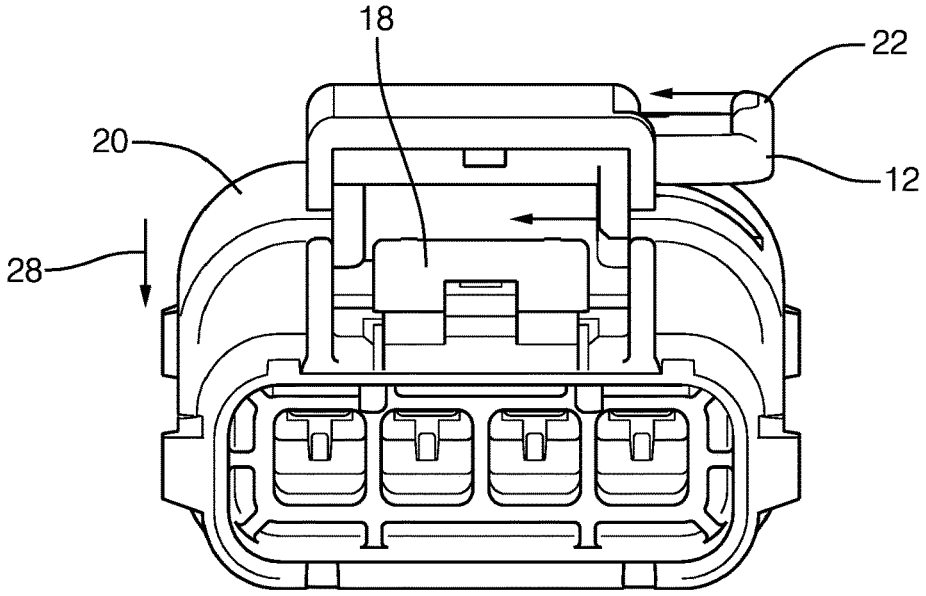
FIG. 2A is an end-view of a portion of a second-housing of the connector of FIG. 1 illustrating the CPA-device in a disengaged-position in accordance with one embodiment.
Figure 2B:
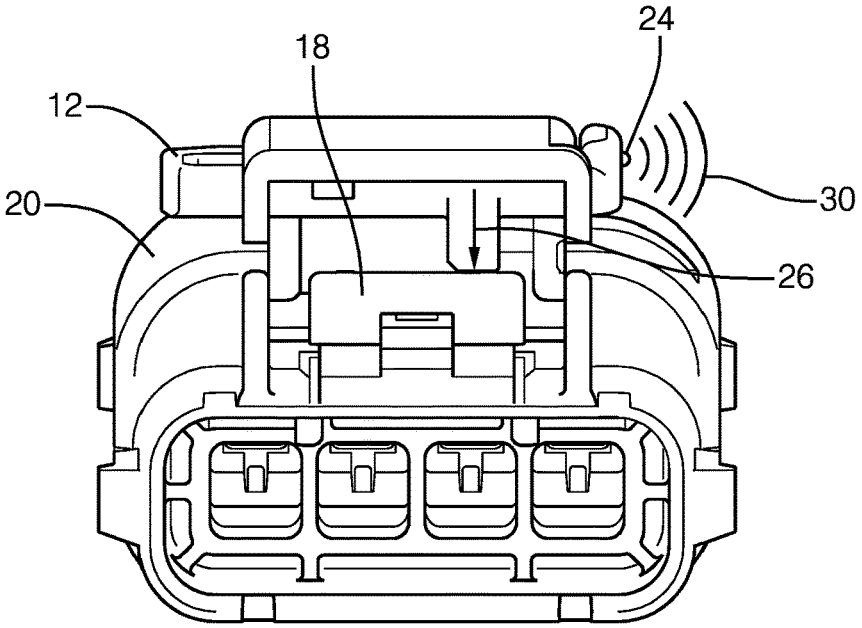
FIG. 2B is an end-view of the portion of the second-housing of the connector of FIG. 1 illustrating the CPA-device in an engaged-position in accordance with one embodiment.

FIGS. 2A-2B are an end-view of the second-housing 20. The CPA-device 12 applies a retention-force 26 (see FIG. 2B) to the connector-latch 18 that deflects the connector-latch 18, thereby applying (i.e. transmitting) the retention-force 26 to the first-housing 14 when the first-housing 14 is mated with the second-housing 20, and the CPA-device 12 is in the engaged-position 24. Preferably, the retention-force 26 is at least 1 Newton (1 N). Experimentation by the Inventors has discovered that a clearance (not shown) between the connector-latch 18 and the first-housing 14 of less than 0.1 millimeters (0.1 mm) is sufficient to reduce the movement between the first-housing 14 and the second-housing 20 and thereby increase a reliability of the connector 10 in the high vibration environment.

As shown in FIGS. 2A-2B, the CPA-device 12 is moveable in a direction generally perpendicular to an insertion direction 28 of the first-housing 14 into the second-housing 20. The CPA-device 12 may include a snap feature 30 configured to provide a vibratory-feedback to an assembler that is indicative of a properly positioned CPA-device 12 when the CPA-device 12 is moved to the engaged-position 24.

Figure 3:
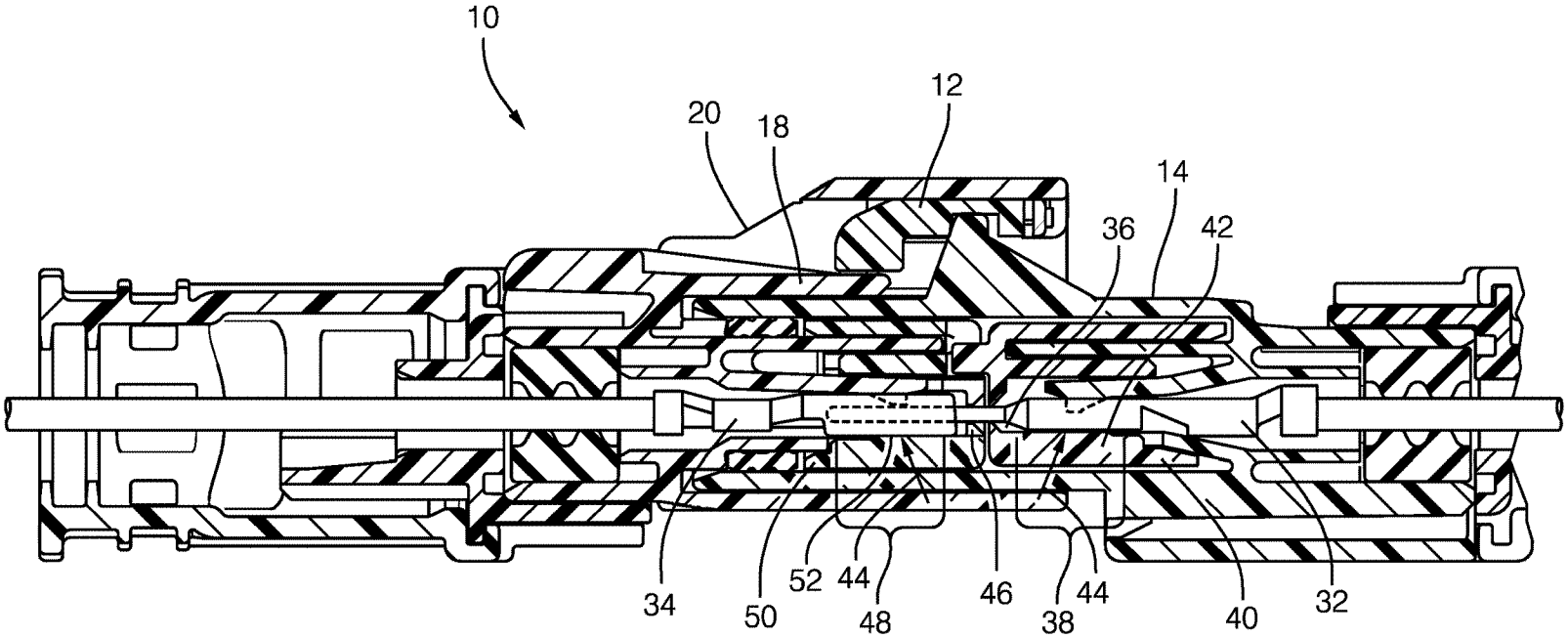
FIG. 3 is a cross-section view of the connector of FIG. 1 in accordance with one embodiment.

FIG. 3 is a cross-section view of the connector 10 of FIG. 1 that includes the wire-bundles, wire seals, and wire strain-relief features (not specifically shown). The first-housing 14 may include a plurality of electrical-terminals 32 and the second-housing 20 may include a plurality of corresponding electrical-terminals 34 configured to mate with the plurality of electrical-terminals 32 of the first-housing 14. The first-housing 14 may define a plurality of slots 36 that define apertures 38, wherein a portion of the plurality of electrical-terminals 32 are disposed within the apertures 38. The connector 10 may further include a terminal-lock 40 that includes a plurality of ribs 42 configured to slideably engage the plurality of slots 36. Preferably, the clearance between the plurality of ribs 42 and the plurality of electrical-terminals 32 is less than 0.1 mm which is sufficient to reduce the movement between the plurality of ribs 42 and the plurality of electrical-terminals 32 and thereby increase the reliability of the connector 10 in the high vibration environment. Alternatively, the plurality of ribs 42 may contact the plurality of electrical-terminals 32 through the apertures 38 and apply a compressive-force 44 to the plurality of electrical-terminals 32. Preferably, the compressive-force 44 is at least 1 N, which is sufficient to inhibit movement between the plurality of ribs 42 and the plurality of electrical-terminals 32, but not so large as to plastically deform the electrical-terminals 32, or to significantly increase the insertion force required to mate the first-housing 14 with the second-housing 20. The terminal-lock 40 is preferably installed and seated into the first-housing 14 prior to mating the first-housing 14 with the second-housing 20, and may include retention-features to prevent the terminal-lock 40 from unintentional disassembly.

The second-housing 20 may also define a second plurality of slots 46 that define second-apertures 48, wherein a portion of the plurality of corresponding electrical-terminals 34 are disposed within the second-apertures 48, as illustrated in FIG. 3. The connector 10 may further include a second terminal-lock 50 that may include a second plurality of ribs 52 configured to slideably engage the second plurality of slots 46. Preferably, the clearance between the second plurality of ribs 52 and the plurality of corresponding electrical-terminals 34 is less than 0.1 mm which is sufficient to reduce the movement between the second plurality of ribs 52 and the plurality of corresponding electrical-terminals 34 and thereby increase the reliability of the connector 10 in the high vibration environment. Alternatively, the second plurality of ribs 52 may contact the plurality of corresponding electrical-terminals 34 through the second-apertures 48 and apply the compressive-force 44 to the plurality of corresponding electrical-terminals 34. Preferably, the compressive-force 44 is at least 1 N, which is sufficient to inhibit movement between the second plurality of ribs 52 and the plurality of corresponding electrical-terminals 34, but not so large as to plastically deform the corresponding electrical-terminals 34, or to significantly increase the insertion force required to mate the first-housing 14 with the second-housing 20. The second terminal-lock 50 is preferably installed and seated into the second-housing 20 prior to mating the first-housing 14 with the second-housing 20, and may include retention-features to prevent the second terminal-lock 50 from unintentional disassembly.

Figure 4:
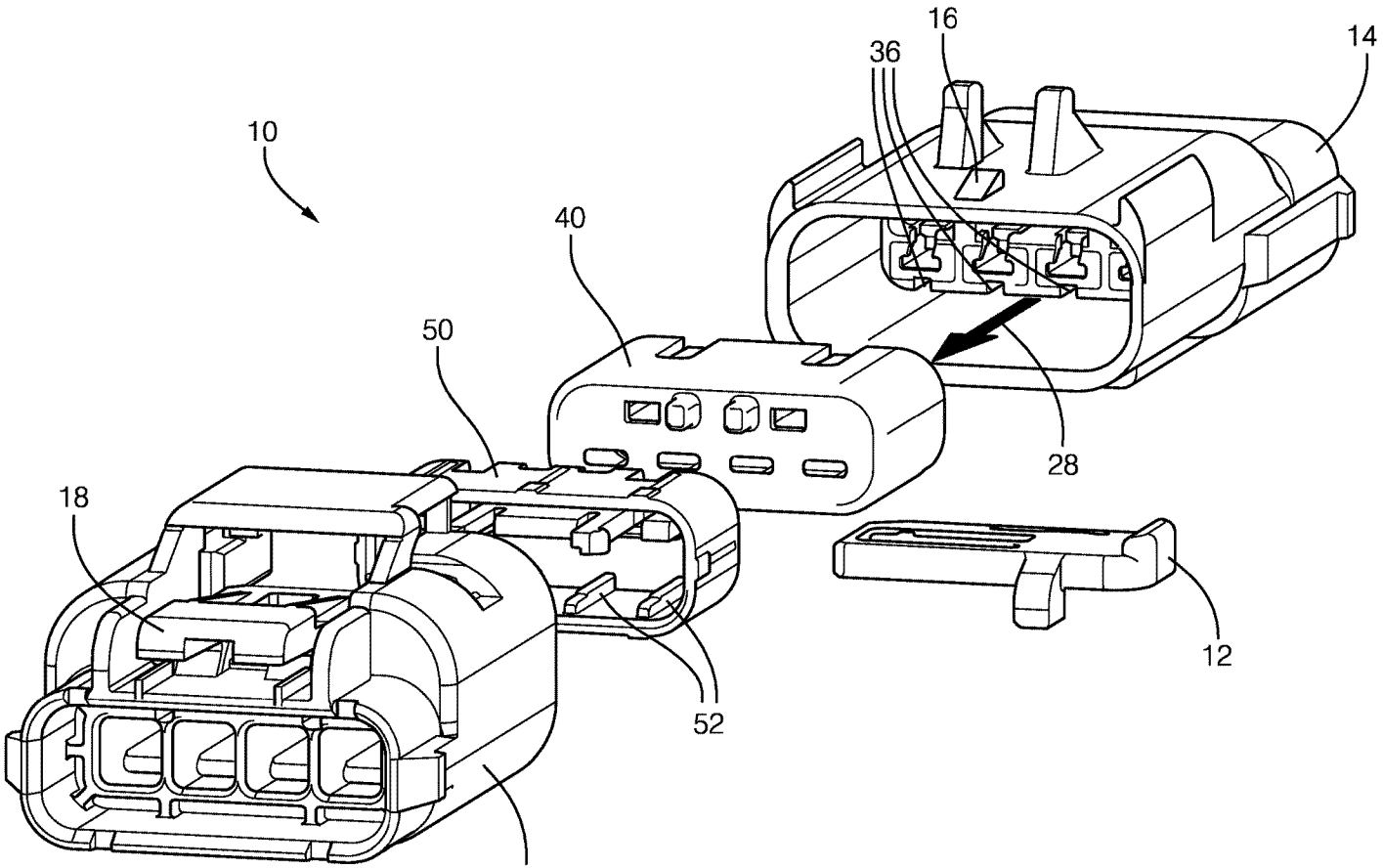
FIG. 4 is an exploded-view of the connector of FIG. 1 in accordance with one embodiment.
Figure 5:
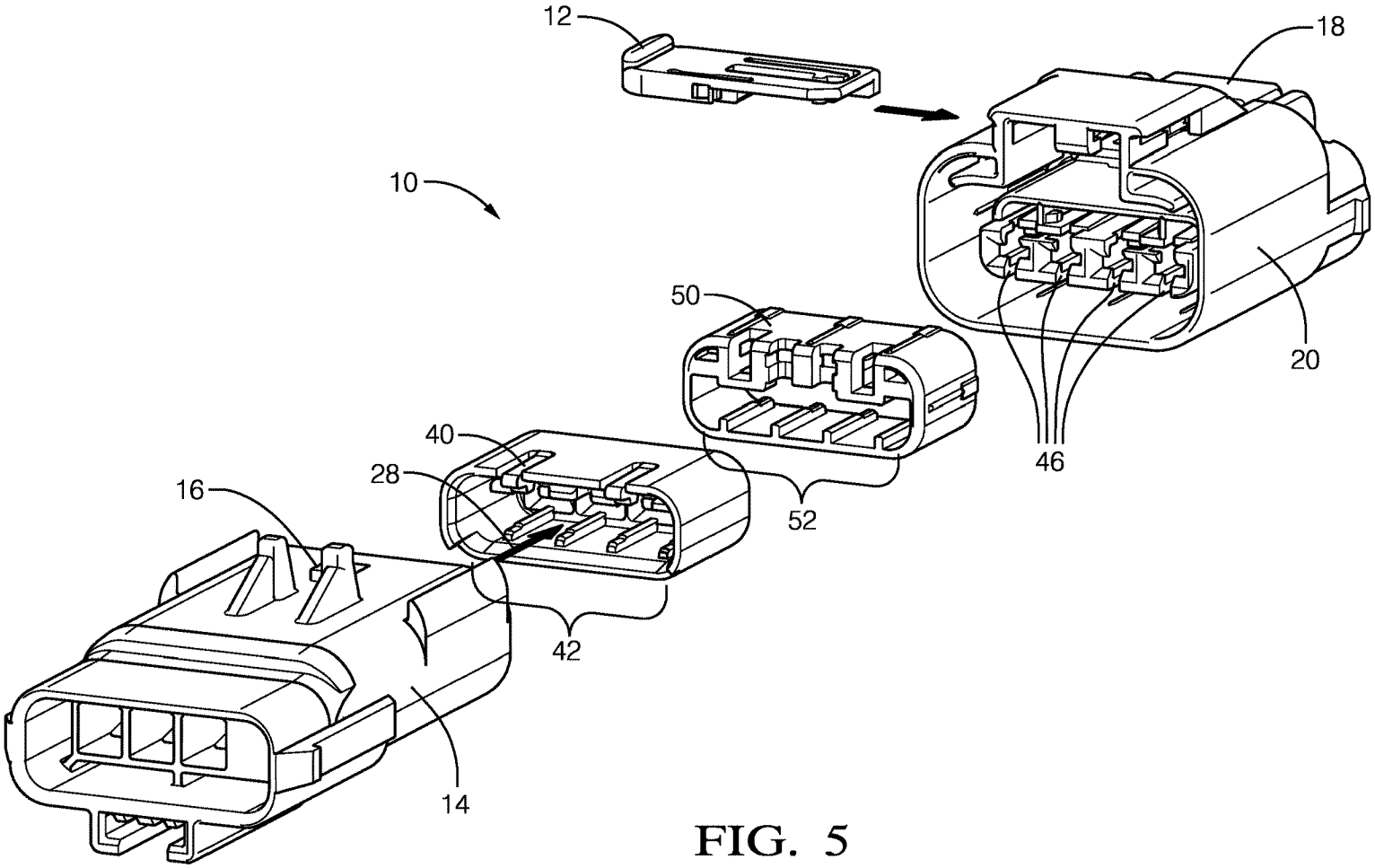
FIG. 5 is the exploded-view of the connector of FIG. 4 rotated 180 degrees in accordance with one embodiment.

FIG. 4 is an exploded-view of the connector 10 showing a front-end of the first-housing 14, with the terminal-lock 40 and second terminal-lock 50 uninstalled, and illustrates the plurality of slots 36 within the first-housing 14. FIG. 5 is the exploded-view of the connector 10 of FIG. 4 rotated 180 degrees showing the front-end of the second-housing 20, and illustrates the second plurality of slots 46 within the second-housing 20, the plurality of ribs 42 in the terminal-lock 40, and the second plurality of ribs 52 in the second terminal-lock 50. The profiles of the plurality of ribs 42 and the second plurality of ribs 52 may include a lead-in section at leading edges (i.e. the first portion of the edges to engage the slots 36 and 46) that may assist in an assembly operation of the terminal-lock 40 and second terminal-lock 50 into their respective housings.

While the connector 10 illustrated here is constructed to interconnect an electrical wire, alternative embodiments of the connector may be used to interconnect other types of conductors, such as fiber optic cables, fluid carrying lines, pneumatic tubing, or a combination of any of these.

Accordingly, a connector 10 is provided. The connector 10 is an improvement over other connectors that must operate in high vibrational environments because the CPA-device 12 prevents excessive movement between the first-housing 14 and the second-housing 20. In addition, the terminal-lock 40 and the second terminal-lock 50 prevent excessive movement between the first-housing 14 and the electrical-terminals 32, and between the second-housing 20 and the corresponding electrical-terminals 34, respectively.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to adapt a particular situation or material to the teachings of the invention without departing from its scope. Any dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

Further, the limitations of the following claims are not written in means-plus-function format and are not intended to be interpreted based on 35 USC § 112(f), unless and until such claim limitations expressly use the phrase "means for" followed by a statement of function void of further structure.

We claim:

1. A connector, comprising:

a first-housing that includes a connector-lock; and a second-housing configured to receive the first-housing, said second-housing includes a connector-latch configured to removably retain the connector-lock when the first-housing is mated with the second-housing, said second-housing includes a connector-position-assurance (CPA)-device slideably mounted to the second-housing and movable from a disengaged-position to an engaged-position, wherein the CPA-device applies a retention-force to the connector-latch that deflects the connector-latch thereby applying the retention-force to the first-housing when the first-housing is mated with the second-housing and the CPA-device is in the engaged-position, wherein the first-housing includes a plurality of electrical-terminals and the second-housing includes a plurality of corresponding electrical-terminals configured to mate with the plurality of electrical-terminals of the first-housing, said first-housing defines a plurality of slots that define apertures, wherein a portion of the plurality of electrical-terminals are disposed within the apertures, wherein said connector further includes a terminal-lock that includes a plurality of ribs configured to slideably engage the plurality of slots and wherein a clearance between the plurality of ribs and the plurality of electrical-terminals is less than 0.1 millimeters.

2. The connector in accordance with claim 1, wherein a clearance between the connector-latch and the first-housing is less than 0.1 millimeters.

3. The connector in accordance with claim 1, wherein the retention-force is at least 1 Newton.

4. The connector in accordance with claim 1, wherein the CPA-device includes a snap feature configured to provide a vibratory-feedback to an assembler indicative of a properly positioned CPA-device when the CPA-device is moved to the engaged-position.

5. The connector in accordance with claim 1, wherein the CPA-device is moveable in a direction generally perpendicular to an insertion direction of the first-housing into the second-housing.

6. The connector in accordance with claim 1, wherein the plurality of ribs contact the plurality of electrical-terminals through the apertures, thereby applying a compressive-force to the plurality of electrical-terminals.

7. The connector in accordance with claim 6, wherein the compressive-force is at least 1 Newton.

8. The connector in accordance with claim 1, wherein the second-housing defines a second plurality of slots that define second-apertures, wherein a portion of the plurality of corresponding electrical-terminals are disposed within the second-apertures, wherein said connector further includes a second terminal-lock that includes a second plurality of ribs configured to slideably engage the second plurality of slots, wherein the clearance between the second plurality of ribs and the plurality of corresponding electrical-terminals is less than 0.1 millimeters.

9. The connector in accordance with claim 8, wherein the second plurality of ribs contact the plurality of corresponding electrical-terminals through the second-apertures, thereby applying a compressive-force to the plurality of corresponding electrical-terminals.

10. The connector in accordance with claim 9, wherein the compressive-force is at least 1 Newton.

* * * * *